United States Patent [19]

Takahashi

[11] 4,040,653

[45] Aug. 9, 1977

[54] CONTROL DEVICE FOR STOPPING THE WITHDRAWING OF UNIT CASES

[75] Inventor: Masaru Takahashi, Nagoya, Japan

[73] Assignee: Mitsubishi Denki Kabushiki Kaisha, Tokyo, Japan

[21] Appl. No.: 696,920

[22] Filed: June 17, 1976

[30] Foreign Application Priority Data

June 19, 1975 Japan ..... 50-83782[U]
June 19, 1975 Japan ..... 50-83781[U]

[51] Int. Cl.[2] ..... E05C 3/04; E05C 7/06

[52] U.S. Cl. ..... 292/202; 292/DIG. 46; 312/222

[58] Field of Search ..... 312/333, 319, 222; 292/59, 60, 67, 202, DIG. 46

[56] References Cited

U.S. PATENT DOCUMENTS 3,450,453 6/1969 Tazaki ..... 312/222
3,622,216 11/1971 Haunost ..... 312/222

*Primary Examiner*—Paul R. Gilliam
*Assistant Examiner*—Alex Grosz
*Attorney, Agent, or Firm*—Oblon, Fisher, Spivak, McClelland & Maier

[57] ABSTRACT

A controlling device for stopping the drawing out of drawer type unit cases holds the unit case at a predetermined position by interlocking a latch with one of a pair of interlocking holes of a partition upon turning an operating shaft through a predetermined angle. The operating shaft has a square part and higher step parts at both sides of the square part and a U-shaped leaf spring is contacted with the square part so as to control the free movement of the operating shaft.

8 Claims, 6 Drawing Figures

CONTROL DEVICE FOR STOPPING THE WITHDRAWING OF UNIT CASES

BACKGROUND OF THE INVENTION

1. Field of the Invention

The present invention relates generally to a control device for stopping the drawing out of drawer type unit cases at a predetermined position. More particularly, the present invention relates to an improved latching mechanism and an improved operating shaft for operating a latch in a control device for stopping the drawing out of such drawer type unit cases at a predetermined position.

2. Description of the Prior Art

It is necessary to draw drawer type unit cases from their main housings or control centers for the purpose of enabling the inspection of the contents thereof, such as electric instruments, for example, relay breaker disconnecting switches, or the like. However, it has been difficult heretofore to hold the unit cases in predetermined positions when the unit case is drawn out.

SUMMARY OF THE INVENTION

It is an object of the present invention to provide a control device for stopping the drawing out of drawer type unit cases at a predetermined position while keeping the unit cases secured without failure.

It is another object of the present invention to provide a control device for stopping the drawing out of such unit cases by holding an operating shaft at a desirable position so as to keep the unit cases in a predetermined position without failure.

The foregoing objects of the present invention have been attained by providing a control device for holding a drawer type unit case in a predetermined position by interlocking a latch with one of a pair of interlocking holes which comprises an operating shaft which is turned by a knob or the like to operate devices and has a square part, higher step parts at both sides of the square part and a spring which contacts the square part and is fixed on a holder for the operating shaft.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts throughout the several figures, and in which.

DETAILED DESCRIPTION OF THE PREFERRED EMBODIMENTS

Figure 1:
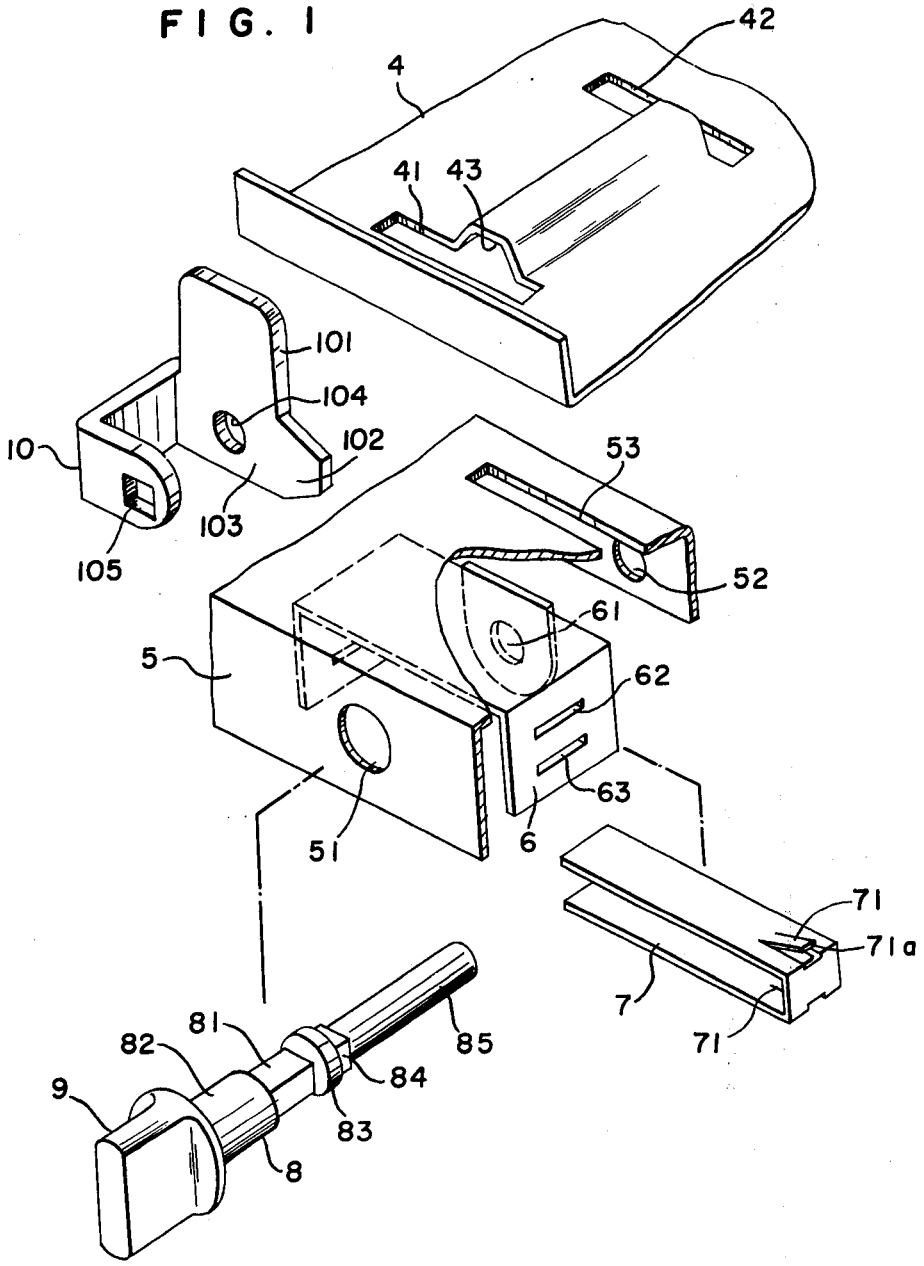
FIG. 1 is a schematic view of the various essential parts of one embodiment of the present invention.

Referring now to the drawings, the preferred embodiments of the present invention will be illustrated.

Figure 2:
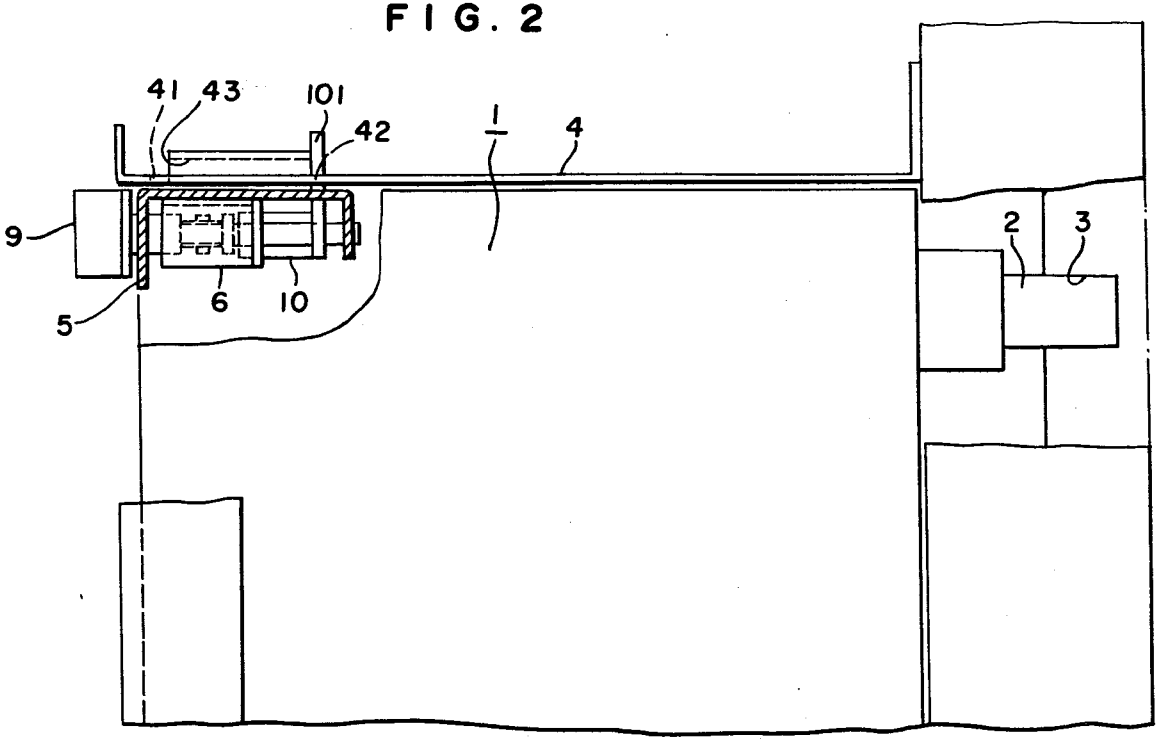
FIGS. 2, 3 and 4 are, respectively, vertical sectional views for showing the operative conditions of the embodiment shown in FIG. 1.
Figure 3:
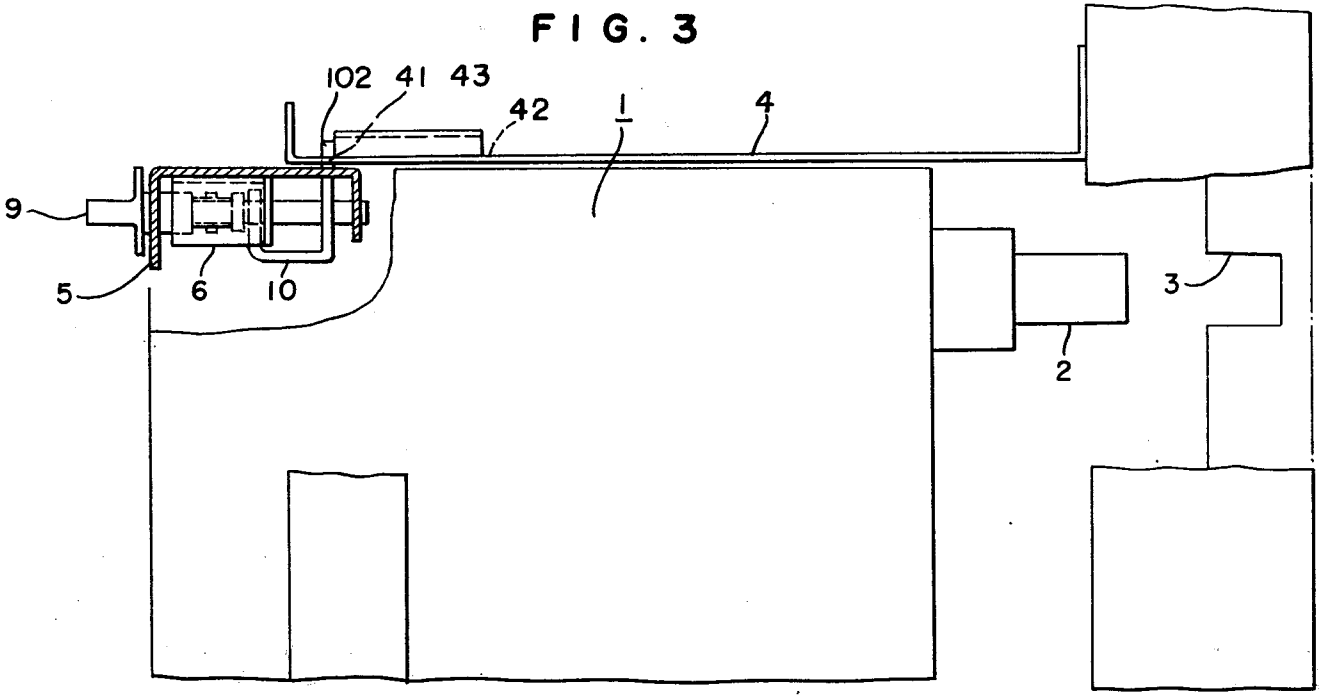

In FIGS. 1 to 3, controlled drawer type unit cases 1 are stored in multistage fashion at a control center of controlled electric instruments, i.e., motors or the like, (not shown) and are slidably fitted on a guide rail (not shown) so as to be put in or drawn out of the housing of the control center. When the drawer type unit case 1 is put in, an attachment connector 2, which is projected from the rear wall of the unit case 1, will be connected to a recess 3 of a vertical bus, for providing electrical connection to the attachment connector 2, which is disposed in the body of the control center.

A metallic or resinous partition 4 arranged above the drawer type unit case 1 has two interlocking holes 41 and 42 of slot like configuration which are arranged in perpendicular relation to the slidable direction of the unit case, and between unit cases 1. A metallic or resinous transversal yoke 5 of U-shaped cross-section is connected to the front upper part of the unit case 1 with the yoke inverted so that the base thereof lies against the upper part of the unit case facing the partition 4 and the legs thereof are directed downwardly with flat surfaces thereof facing or being in parallel relation to the front wall of the unit case. Bearing holes 51 and 52 are respectively formed in the front surface and the rear surface, that is, in the downwardly directed legs, of the transversal yoke. A latch inserting hole 53 of slot configuration is formed on the upper surface or base of the U-shaped transversal yoke 5. A metallic supporter 6 having substantially U-shaped configuration is fixed on a transverse yoke 5 between the front and rear surfaces thereof, and with the leg portions thereof being arranged perpendicular to such front and rear surfaces of the yoke. The supporter 6, if desired, may also be made of a resinous material. A bearing hole 61, which is similar to the bearing holes 51 and 52, is disposed on a rear side of the supporter 6 in a coaxial position with the bearing holes 51 and 52, and a pair of thin rectangular holes 62 and 63 are formed in parallel relation in each of the right and left side surfaces or legs of supporter 6. In the thin rectangular holes, the legs of a metallic leaf spring 7 having substantially a U-shape, which also can be a resinous leaf spring, is inserted and fitted. A stopper or bent up tab portion 71 is formed on the legs of the leaf spring 7 adjacent the base thereof as a one-piece structure therewith, and the ends 71*a* of the leaf spring stoppers are contacted with an inner surface of the supporter or holder 6.

A metallic or resinous operating shaft 8 is rotatably received by the three bearing holes 51, 52 and 61, and has an operating knob 9 fitted at one end thereof. A square part 81 is formed on a part of the shaft and higher cylindrical steps 82 and 83, or steps having greater diameters than the lengths of the sides of the square part 81, are formed at both sides of the square part. The square part 81 of the operating knob 9 is held in contacting relation between the legs of the leaf spring 7. A square part 84 and an elongate cylindrical part 85 complete the shaft of the operating knob 9, being formed as a one piece structure including the parts 81, 82, 83, 84 and 85.

A metallic latch 10 having a substantially U-shaped configuration, which also can be a resinous latch, is fixed on the operating shaft 8 and is rotated with the shaft, and includes in one leg a main pawl 101, which is interlocked with the interlocking hole 41 or 42, and a small pawl 102, which is shifted by 90° from the main pawl. The small pawl 102 has a size which can slidably move in a narrow groove 43 formed in trapezoidal shape in the partition 4 between the interlocking holes 41 and 42. The opposite end 103 to the pawl 101 is flat and is not interlocked with interlocking holes 41 and 42, even though the flat end 103 is turned to face the upper direction by the turning operation of the knob 9. The cylindrical part 85 of the shaft of the control knob is inserted in a round hole 104 in latch 10 and the square part 84 of the shaft is inserted in a rectangular hole 105 formed in the other leg of the latch 10. The legs of the latch 10 are formed as a one piece structure by one sheet of material.

In this structure, the knob 9 is turned to face the flat end 103 in the upper direction and the unit 1 is put in the control center whereby the attachment connector 2 at the rear wall of the unit case is connected into the recess 3. The knob 9 is then turned 180 degrees in the clockwise direction whereby the main pawl 101 is inserted in the latch inserting hole 53 of the yoke 5 to interlock also with the interlocking hole 42 of the partition 4 and the unit case 1 is thus held in position. In the cases where inspection or the like is required, the knob 9 is turned through 90 degrees in the counterclockwise direction whereby the small pawl 102 is arranged in the groove 43 of partition 4, so that the unit case 1 can be drawn out.

When the unit case 1 is drawn out through a predetermined distance, the connection of the attachment connector 2 with the recess 3 is disconnected, as shown in FIG. 3, and the small pawl 102 is contacted with the peripheral part of the interlocking hole 41, whereby the drawing movement is stopped. When the knob 9 is turned through 90 degrees in a clockwise direction, the main pawl 101 is interlocked with the interlocking hole 41 and the unit case 1 is kept in its position.

In accordance with this embodiment of the invention, the drawer type unit case is stopped at a predetermined position without failure in drawing out the unit case and the unit case can be kept in its position when the unit case is drawn out for use of tools in repairing or for inspection. Accordingly, the inspection or the like can be safely carried out without failure. The main pawl for holding the unit case at a predetermined position and the small pawl as a stopper in the drawing operation are formed in one latch, whereby the pawl operative mechanism is simple and can be operated by one knob.

Figure 4:
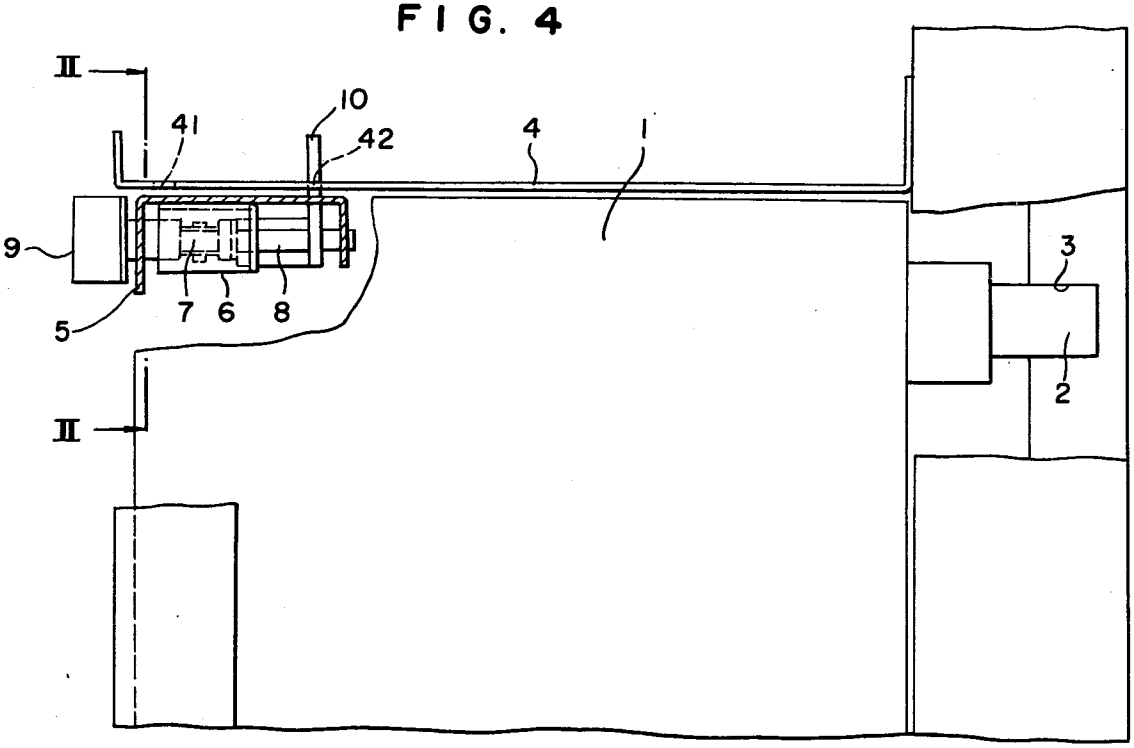
Figure 5:
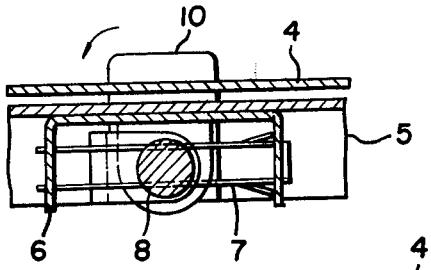
FIG. 5 is a sectional view taken along the line II—II of FIG. 4.
Figure 6:
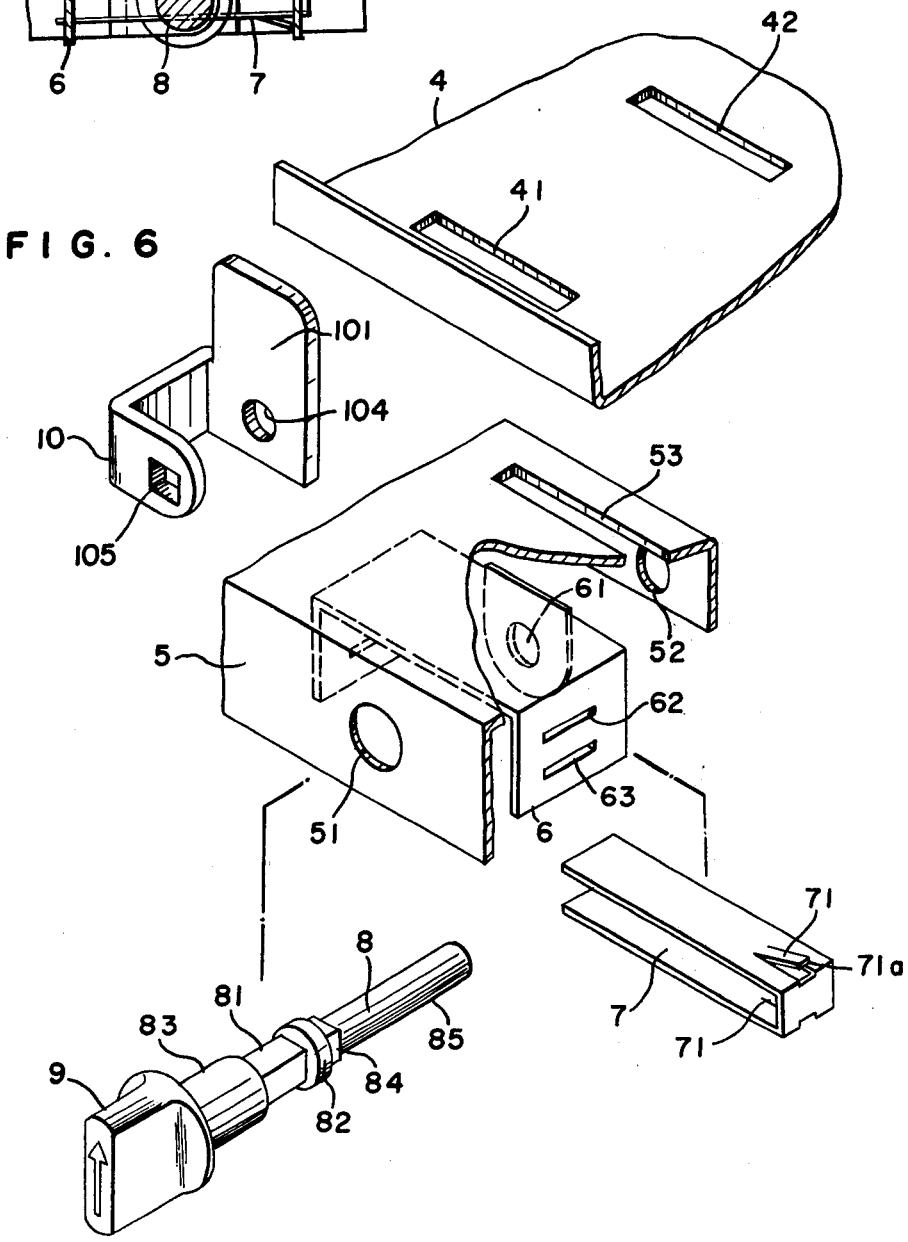
FIG. 6 is a schematic view of the various essential parts of another embodiment of the invention.

Referring now to FIGS. 4, 5 and 6, another embodiment will be illustrated, wherein the operating shaft for operating the latch is improved. In FIGS. 4 to 6, the controlled unit cases 1 are stored in multistage fashion at a control center of controlled electric instruments (not shown) and are slidably fitted on a guide rail (not shown) so as to be put in or drawn out of the housing of the control center. When the unit case 1 is put in, the attachment connector 2, which is projected from the rear wall of the unit case 1, will be connected to the recess 3, which is disposed in the housing body of the control center. A metallic or resinous partition 4 has two interlocking elongate holes 41 and 42 which are interlocked with a latch whose description follows and are arranged in perpendicular relation to the slidable direction of the unit case between the unit cases 1. A U-shaped metallic or resinous transversal yoke 5 is connected to the front upper part of the unit case 1. Bearing holes 51 and 52 are respectively formed in the front and rear surfaces, or in the legs, of the U-shaped transversal yoke 5. A latch inserting hole 53 is formed in the upper surface, or the base, of the transversal U-shaped yoke 5.

A metallic holder 6, having a substantially U-shape, is fixed on the transverse yoke 5. The holder can be made of resin, if desired. A bearing hole 61, which is similar to the bearing holes 51 and 52, is disposed in the rear side in a coaxial position with holes 51 and 52, and a pair of thin rectangular holes 62 and 63 are formed in parallel relation in the right and left side surfaces, or the legs, of the U-shaped holder 6. In the thin rectangular holes, the legs of a metallic leaf spring 7, having substantially a U-shape, is inserted and fitted. Obviously a resinous leaf spring is possible also. A stopper 71 is formed on each of the legs of the leaf spring 7 as a one piece structure and the ends 71*a* of the leaf spring stoppers are contacted with an inner surface of the holder 6.

A metallic or resinous operating shaft 8 is rotatably fitted in the three bearing holes 51, 52 and 61. An operating knob 9 is fitted at one end of the shaft 8. A square part 81 is formed on a part of the shaft and higher cylindrical steps 82 and 83 are formed at both sides of the square part. The square part 81 is held in contacting relation between the legs of the leaf spring 7. A square part 84 and a cylindrical part 85 complete the operating shaft, which is formed as a one piece structure including the parts 81, 82, 83, 84 and 85. A metallic or resinous latch 10 has a projected pawl 101 as a one piece structure and is turned with the shaft by being fitted to the operating shaft 8 and the pawl 101 is thus inserted in the latch inserting hole 53 and is interlocked with the interlocking hole 41 or 42. The cylindrical part 85 of the operating shaft is inserted in a round hole 104 of latch 10 and the square part 84 is inserted in a rectangular hole 105. In this structure, when the knob 9 is turned to lay down the latch 10 and the controlled unit case 1 is pulled or drawn to the predetermined position in the housing body of the control center, under the condition that the latch 10 is not projected, the attachment connector 2 is inserted and connected to the recess 3. When the knob 9 is turned to stand the latch 10, the latch 10 is inserted in the latch inserting hole 53 and is interlocked to the interlocking hole 42 of partition 4 and the controlled unit case 1 is kept in position. When the controlled unit case 1 is drawn out, for the purpose of inspection or the like, the knob 9 is turned to lay down the latch 10 and the unit case 1 is drawn out to the predetermined position and the knob 9 is then turned to stand or raise the latch 10, whereby the latch 10 is interlocked with the other interlocking hole 41, and the unit case 1 is thus kept in position without drawing the unit case off or putting it in by shock or vibration.

The operating shaft 8 is turned under the operation of turning the knob 9. In the operation, the square part 81 is held by the leaf spring 7 from both sides, whereby the angle for turning the operating shaft 8 is defined to hold the operating shaft to the turned position. Accordingly, the operating shaft is not accidentally turned. Moreover, the higher step parts 82 and 83 formed at both sides of the square part 81 are contacted with the leaf spring 7 to hold the operating shaft 8 whereby back and forth movement of the operating shaft 8 can be prevented.

In accordance with this embodiment, the square part is formed on the operating shaft and the higher step parts are formed at both sides of the square part, whereby the operating shaft can be held only by contacting the leaf spring, having a U-shape, to the square part and the angle for turning the operating shaft can be defined. Accordingly, the turning operation of the operating shaft by the knob can be easily attained.

Obviously, many modifications and variations of the present invention are possible in light of the above teachings. It is therefore to be understood that within the scope of the appended claims, the invention may be practiced otherwise than as specifically described herein.

I claim:

1. In a control device for stopping the withdrawing of a drawer type unit case to a predetermined position by interlocking a main pawl of a latch carried by the unit case, which is slidable in the direction of sliding of said unit case and is fitted on an operating shaft, also carried by the unit case, and rotatable therewith about the axis thereof, with a partition between adjacent unit cases, the improvement which comprises:

a yoke secured to said unit case in the upper frontal area thereof, said yoke having aligned holes therein for rotatably receiving said operating shaft and a latch receiving elongate opening for receiving said main pawl of said latch in one position thereof;

said partition being disposed between adjacent vertically arranged unit cases, adjacent the front end of the cabinet housing said unit cases, said partition having elongate parallel interlocking openings therein arranged parallel to said latch receiving opening of said yoke and a fine groove formed perpendicular thereto and connecting said interlocking openings, so that in a closed position of said unit case, one of said interlocking openings in said partition is aligned with said latch receiving opening of said yoke, whereby said main pawl of said latch locks said unit case in a closed position;

said latch also having a small pawl slidable in said fine groove of said partition, said small pawl facing said fine groove upon turning of said latch to a second position, whereby the unit case may be drawn out in the direction of the operating shaft and the small pawl may be interlocked to the other of said interlocking openings in said drawing step so as to stop said unit case at a predetermined position established by said other of said interlocking openings of said partition.

2. A control device for stopping the withdrawing of a drawer type unit case according to claim 1, wherein said small pawl of said latch is formed perpendicular to said main pawl.

3. A control device for stopping the withdrawing of a drawer type unit case according to claim 1, wherein said operating shaft has an integrally formed square part and a cylindrical part, and said latch has a U-shape, with a rectangular hole being formed in one leg of the U-shape thereof and having the square part of the operating shaft fitted therein, and a round hole is formed in the other leg of the U-shape latch for receiving the cylindrical part of the operating shaft.

4. A control device for stopping the withdrawing out of a drawer type unit case according to claim 1, wherein said partition is constructed from one metallic sheet.

5. A control device for stopping the withdrawing of a drawer type unit case according to claim 1, wherein said operating shaft has a further square part and higher cylindrical steps at both sides thereof and a spring is contacted with said further square part.

6. A control device for stopping the drawing out of a drawer type unit case according to claim 5, wherein said spring is fixed on a holder for holding said operating shaft and is substantially U-shaped and said further square part of said operating shaft is held by legs of said U-shaped spring.

7. A control device for stopping the withdrawing out of a drawer type unit case according to claim 6, wherein said holder is fitted to the unit case at the front inner side of said yoke and has at least two elongate parallel holes in which the legs of said spring are inserted.

8. A control device for stopping the withdrawing out of a drawer type unit case according to claim 7, wherein said holder is substantially U-shaped and stoppers are formed on said spring legs, integral therewith, being contactable with the inner surfaces of said holder in the condition of complete insertion of said spring legs into said holes of said holder so as to prevent slipping of the spring from said holder.

* * * * *